United States Patent [19]

Dang et al.

[11] Patent Number: 4,625,440

[45] Date of Patent: Dec. 2, 1986

[54] TENTERING FRAME FOR SHEET-LIKE MEMBERS

[75] Inventors: Hiep D. Dang; Roy L. Hicks; Joel F. M. Leathers, all of Lake Jackson, Tex.

[73] Assignee: The Dow Chemical Company, Midland, Mich.

[21] Appl. No.: 759,769

[22] Filed: Jul. 29, 1985

[51] Int. Cl.[4] ..... D06C 3/08

[52] U.S. Cl. ..... 38/102.5; 38/102.91; 160/395; 204/255

[58] Field of Search ..... 38/102.1, 102.2, 102.91, 38/102.4, 102.5; 160/380, 382, 383, 400, 402, 403, 378, 395, 391, 392; 204/255, 268, 252, 245, 285; 223/96

[56] References Cited

U.S. PATENT DOCUMENTS

| | | | |
|---|---|---|---|
| 381,204 | 4/1888 | Bailey | 38/102.4 |
| 1,255,010 | 1/1918 | Hopkins | 38/102.5 |
| 1,987,860 | 1/1935 | Milone | 160/403 |
| 2,893,162 | 7/1959 | Knowles | 38/102.1 |
| 3,482,343 | 12/1969 | Hamu | 38/102.91 X |
| 3,601,912 | 8/1971 | Dubbs | 38/102.91 |
| 3,924,343 | 12/1975 | Johnson | 38/102.1 |
| 4,144,660 | 3/1979 | Lamb | 38/102.5 |
| 4,179,830 | 12/1979 | Lamb | 38/102.5 |
| 4,422,251 | 12/1983 | Hedrick | 38/102.2 |

*Primary Examiner*—Werner H. Schroeder
*Assistant Examiner*—Andrew M. Falik
*Attorney, Agent, or Firm*—J. R. Prieto

[57] ABSTRACT

A tentering apparatus for tensioning a sheet-like member, for example, a membrane used in an electrolyzer. The tentering apparatus includes four clamping assemblies arranged in a picture frame shape configuration with four corner members and a connector member for connecting the clamping assemblies to the corner members and adapted for tensioning the sheet-like member.

7 Claims, 7 Drawing Figures

TENTERING FRAME FOR SHEET-LIKE MEMBERS

BACKGROUND OF THE INVENTION

This invention relates to an apparatus and method for tentering sheet-like members and more particularly this invention relates to a tentering frame and method for tentering membranes used in electrolyzers.

Electrolyzers employing a membrane (hereinafter "membrane cells") may be of the filter press type, for example, as described in U.S. Pat. Nos. 4,108,742 and 4,111,779. Membrane materials commonly used for membrane cells include, for example, those marketed by E. 1. duPont de Nemours & Company under the trademark Nafion® and by Asahi Glass Company Ltd. under the trademark Flemion®. The membranes are available principally in sheet-like form. The membrane is used for separating the cell into electrode compartments containing electrolyte. For example, a membrane cell used for the production of a halogen and an alkali metal hydroxide may use an ion exchange membrane to separate an anode compartment containing anolyte and an anode member from a cathode compartment containing catholyte and a cathode member.

In a membrane cell used, for example, in the production of a halogen and an alkali metal hydroxide, it is important to keep the distance between electrodes to a minimum to reduce the voltage drop through the catholyte and anolyte, and thus reduce energy consumption of the cell. Furthermore, it is advantageous to keep a uniform spacing between an electrode and the membrane to obtain a uniform current distribution. Any contact between the membrane and an electrode may cause a great amount of current passage and membrane burning at the point of contact. In some applications, the spacing between an electrode and membrane may be no greater than 1 millimeter. Therefore, the membrane is kept as flat or planar as possible when installed between electrodes of an electrolytic cell.

Some membrane materials are known to absorb water and expand a certain percentage when wetted. Thus, it is common for these types of membranes to form wrinkles during operation of a cell when the membrane is wetted with electrolyte. A wrinkled membrane can come into contact with the cell electrodes and cause the problems described above. A wrinkled membrane can also reduce the circulation of the electrolyte and trap gases produced in the cell between the electrode and the membrane face. This may result in a nonuniform increase in resistivity of the electrolyte solution in the interelectrode space with a nonuniform current distribution across the membrane surface in the vertical direction. It is important, therefore, to keep the membrane as flat as possible and prevent wrinkles from forming on the membrane surface when installing in the cell.

Heretofore, the installation of membranes between electrode compartments required a crew of about six to eight people holding the membrane in place and pulling the membrane by hand to tension the membrane between electrode units until the electrode compartment units were squeezed together by, for example, a hydraulic ram. Invariably, this procedure led to formation of wrinkles on the membrane due to uneven forces pulling at the membrane by the crew. The wrinkles formed at a gasket bearing surface of the membrane caused leakage of electrolyte into the atmosphere or electrode compartments. Furthermore, installation of the membrane consumed a relatively long period of time and dropping the membrane, which meant starting the installation process over, was always a risk.

It is desired to minimize the problems discussed above by providing an apparatus and method for tentering a membrane used in a membrane cell and maintaining the membrane planar when installed in a membrane cell.

SUMMARY OF THE INVENTION

The present invention is directed to an apparatus for tentering a generally planar sheet-like member. The apparatus comprises (a) at least four clamping assemblies adjacent each other in a picture frame type configuration and adapted for clamping at least a portion of the periphery of the sheet-like member, the clamping assemblies comprising at least two elongated, generally planar members wherein the elongated portion of the planar members are adjacent and parallel each other and held together with a fastening means, (b) at least four corner members interposed between the four clamping assemblies and adapted to be connected at the ends of the four clamping assemblies, and (c) means for connecting the clamping assemblies to the corner members; wherein the sheet-like member is tensioned by at least one of the means for connecting the clamping assemblies to the corner members.

DETAILED DESCRIPTION OF PREFERRED EMBODIMENTS

Figure 1:
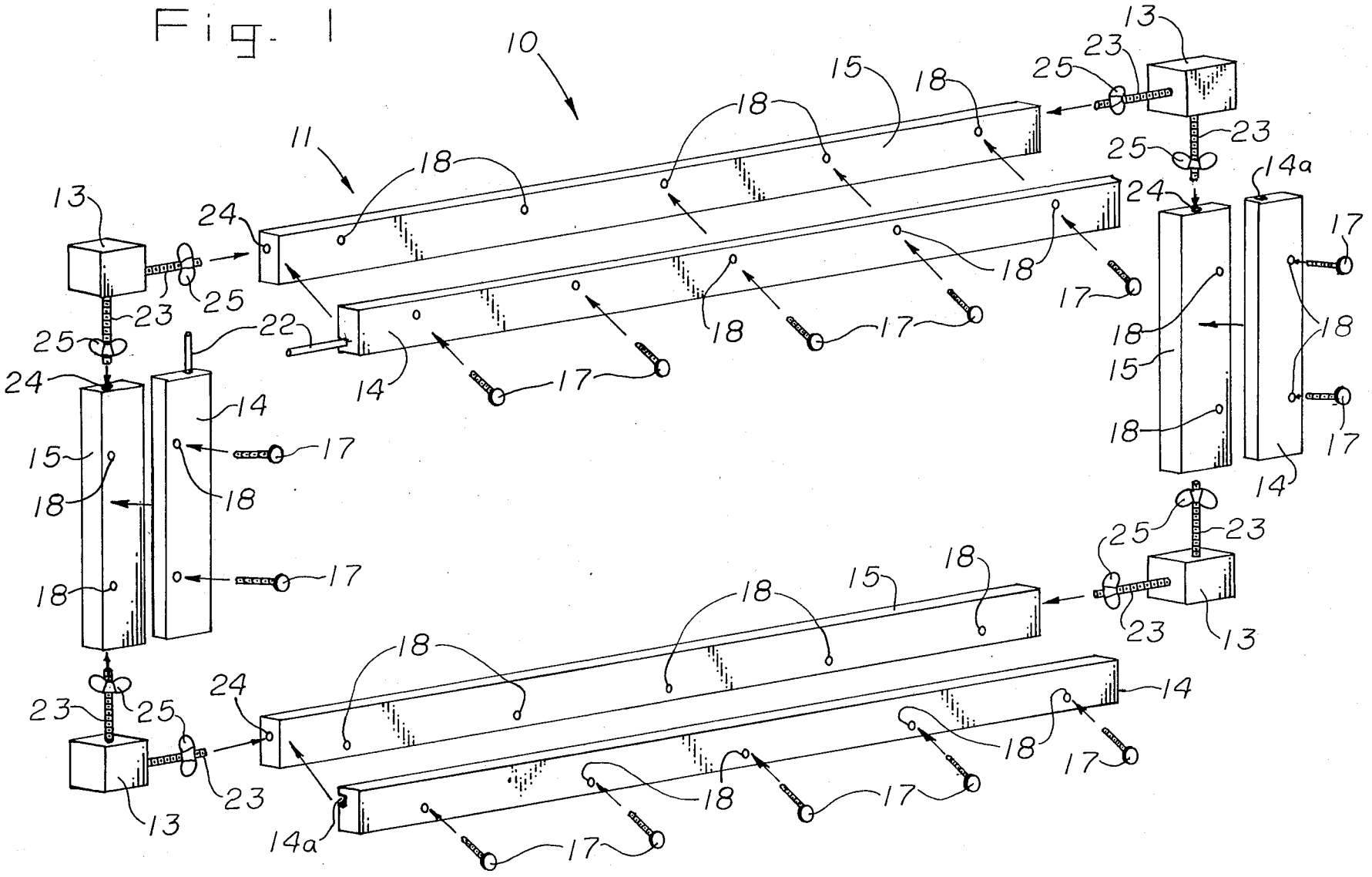
FIG. 1 is an exploded, perspective view of the tentering apparatus of the present invention showing four clamping assemblies and four corner members in a picture frame type configuration.
Figure 3:
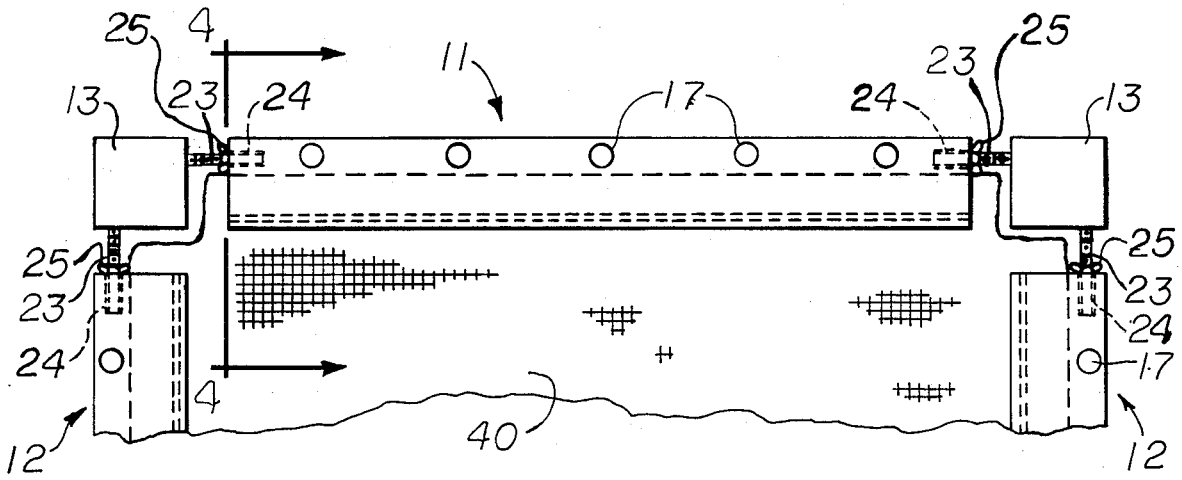
FIG. 3 is a front view of a portion of an assembled tentering apparatus with a sheet-like member.

With reference to FIGS. 1–5, there is shown various preferred embodiments of the apparatus of the present invention which is designated generally as numeral 10 (hereinafter tentering frame 10). As shown in FIG. 1, the tentering frame 10 may consist essentially of a first and second pair of clamping assemblies indicated generally by numerals 11 and 12 connected and fastened together in a rectangular picture frame type configuration with four corner members 13. The tentering frame 10 is used for tensioning a sheet-like member 40, as shown in FIG. 3. The tentering frame 10, in this instance, is rectangular in shape, but broadly speaking, the tentering frame 10 may be of any other shape as that of the sheet-like member, for example, square or hexagonal.

Generally, the tentering frame 10 comprises a first pair of longitudinal clamping assemblies 11 which are generally parallel and spaced apart, and assemblies 11 are positioned between a second pair of transversal clamping assemblies 12 which are generally parallel and spaced apart. The clamping assemblies 11 comprise a first and second clamping bar 14 and 15 which are parallel and adjacent to each other with a releasable fastening means for tightening and securing the clamping bars 14 and 15 together. The releasable fastening means may be in the form of a plurality of threaded rods or clamping screws 17 and a plurality of threaded openings 18 adapted for receiving the clamping screws 17. The threaded openings 18 may extend through at least one bar 14 and at least a portion of the other bar 15. In the embodiment shown in FIG. 4 of the present invention, the threaded openings 18 completely extend through both clamping bars 14 and 15.

Figure 5:
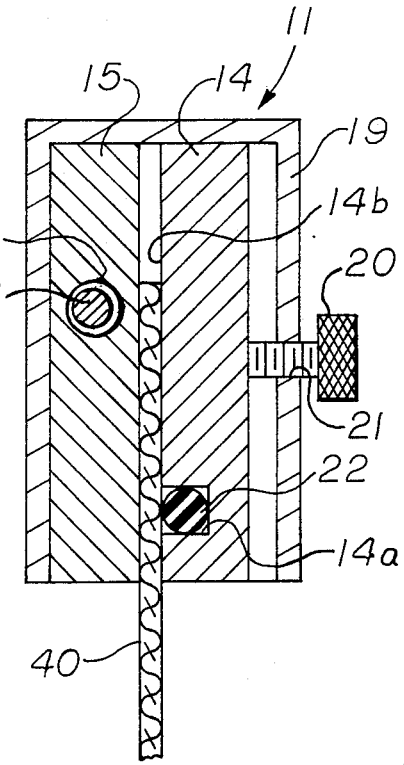
FIG. 5 is a view similar to FIG. 4 and illustrating another embodiment of a means for clamping the sheet-like member.

In another embodiment of the present invention the clamping assemblies 11 and 12 each may comprise a U-shaped clamping channel, a pair of clamping bars and a releasable fastening means for tightening and securing the clamping bars together. "U-shaped" refers to the view of the clamping channel in cross-section. A clamping assembly 11 is shown in FIG. 5 wherein the clamping bars 14 and 15 are parallel and adjacent each other and juxtaposed between the arms of the "U" or flanges of the U-shaped clamp channel 19. Preferably, one flange of the U-shaped clamp channel 19 contains a releasable means in the form of a plurality of clamping screws 20 and a plurality of threaded openings 21 adapted for receiving the clamping screws 20.

Figure 4:
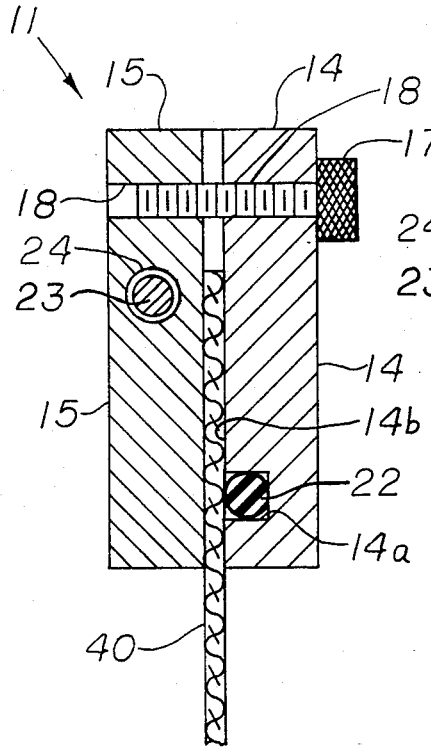
FIG. 4 is a cross-sectional view taken along line 4—4 of FIG. 2 and illustrating one embodiment of a means for clamping the sheet-like member.

Referring now to FIGS. 4 and 5, a means for tightly securing or gripping the sheet-like member 40 between the clamping bars 14 and 15 is provided on at least one of the clamping bars. The gripping means in this instance, may be, for example, a securing member 22 and a longitudinal recess **14*a* adapted to receive the securing member 22. The recess 14*a* is positioned along the inner surface 14*b* of bar 14 in contact with the sheet-like member 40. The securing member 22 may be in the form of a solid piece, a strip or a tubing. Preferably, the securing member 22** may be made of resilient materials such as rubber, ethylene-propylene-diene monomer (EPDM), chlorinated polyethylene (CPE) and neoprene. Another gripping means (not shown) useful in the present invention may be, for example, a longitudinal rib on at least one clamping bar and a longitudinal recess adapted for receiving the longitudinal rib on at least the other clamping bar. Other gripping means (not shown) may include, for example, a knurled surface or a roughened uneven surface located on at least a portion of the inner surface of at least one clamping bar in contact with the sheet-like member.

Figure 2:
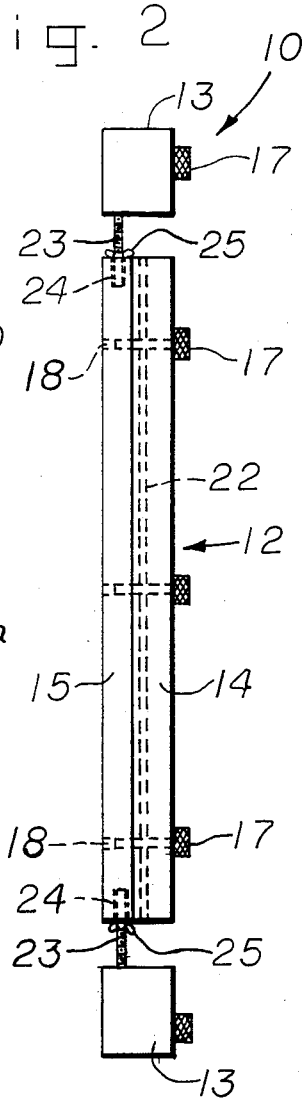
FIG. 2 is a side view of the assembled tentering apparatus of FIG. 1.

With reference to FIGS. 1–4, again there is shown a threaded rod 23, attached to corner members 13 for connecting and fastening the corner members 13 to each of the clamping assemblies 11 and 12. Any means for attaching the rod 23 to corner members 13 may be used, such as welding or threading. The corner members 13 in FIGS. 1, 2 and 3 are shown as square blocks, however, the shape of the corner members are not to be limited to square blocks, but can be any shape desired. Each of the corner members 13, herein referred to as corner block members 13, contains at least two threaded rods 23. Each end of one of the clamping bars 14 or 15, in this instance clamping bar 15, of the clamping assemblies 11 and 12 contains a cavity 24 adapted to receive the end of the threaded rod 23. A rotatable wing nut 25 positioned on the threaded rod 23 is used for tensioning the sheet-like member. The wing nut 25 may be rotated against the clamping bars 15 or, as shown in FIGS. 1–4, or against the corner block member 13 (not shown) to tension the sheet-like member.

Figure 6:
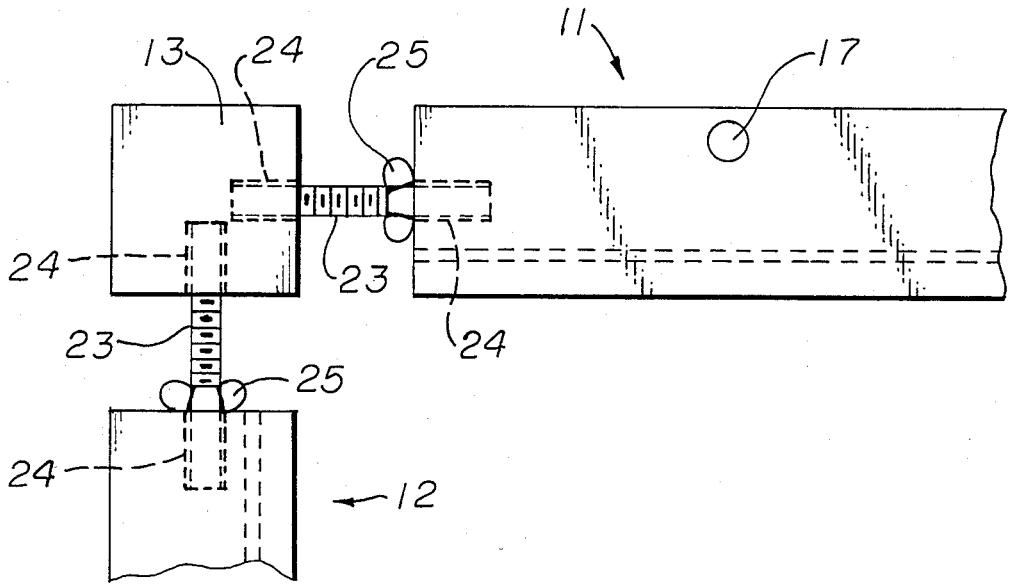
FIGS. 6 and 7 show additional embodiments of alternate ways of attaching the clampling assemblies to the corner member.

In another embodiment of the present invention as shown in FIG. 6, the clamping assemblies 11 and 12 are connected to corner block member 13 with a free-floating threaded rod 23. One end of the rod 23 is set in cavity 24 of the clamping bar 15 and the other end of the rod 23 is set in a cavity 26 of corner block member 13.

Figure 7:
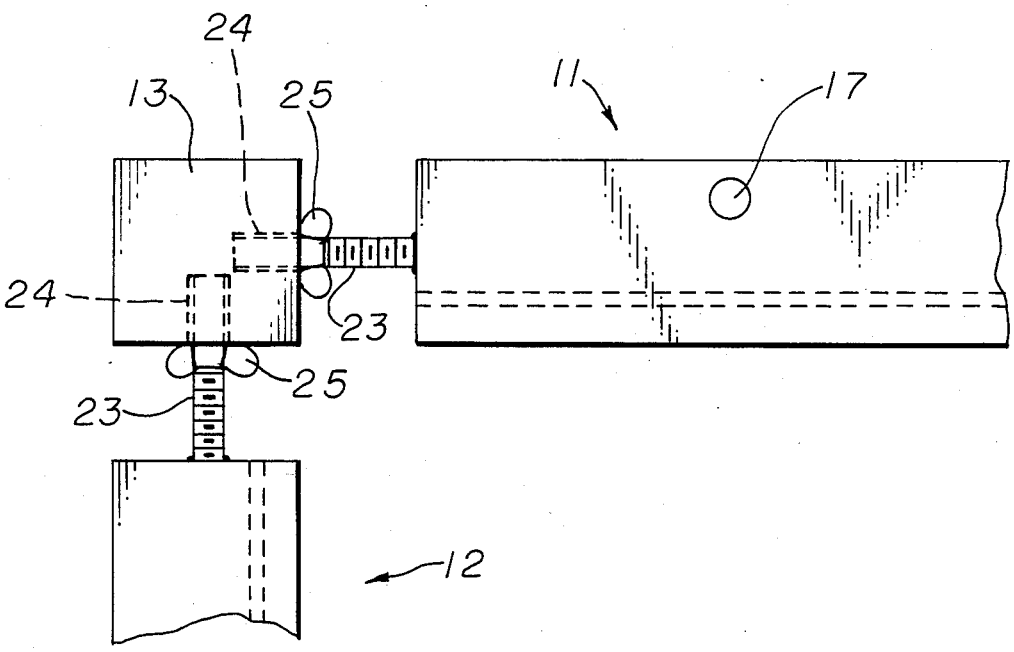

In yet another embodiment of the present invention as shown in FIG. 7, the threaded rod 23 may be attached to the clamping bar 15, by any means such as welding or threading, and set in cavity 26 of the corner block member 13.

In a preferred method of carrying out the stretching or tensioning of the sheet-like member using the tentering frame 10 of the present invention, the edges of two opposite and generally parallel ends of a sheet-like member are sandwiched between clamping bars 14 and 15 of the pair of clamping assemblies 11. The sheet-like member is secured to the clamping assemblies 11 by tightening the clamping screws 17. A pair of corner block members 13 with rigidly attached first and second threaded rods 23 are assembled to each of the clamping assemblies 12 by inserting the end of the first threaded rods 23 with wing nuts 25 into cavities 24 of clamping assemblies 12. The two remaining edges of the sheet-like member are sandwiched between clamping bars 14 and 15 and the sheet-like member is secured to the clamping assemblies 12 by tightening the clamping screws 17. The assemblies 12 with the corner block members 13 attached thereto are connected to the assemblies 11 by inserting the end of the second threaded rods 23 with wing nuts 25 into the cavities 24 of the clamping assemblies 11. The wing nuts 25 are then tightened against the clamping bars 15 to push the corner block members 13 outwardly and perpendicular to the ends of the sheet-like members. The wing nuts 25 may be tightened until any wrinkles present on the sheet-like member are removed or a desired tautness of the sheet-like member is achieved.

In its broadest application, the apparatus of the present invention may be used where a generally planar sheet-like member is desired to be tensioned or stretched. For example, the apparatus of the present invention is particularly useful for tensioning membranes employed in electrolyzers, in particular, electrolyzers of the filter press type, which may be monopolar or bipolar. Such electrolyzers may be used, for example, for the production of chlorine and an alkali metal hydroxide by processes well-known in the art. Examples of such electrolyzers are described in U.S. Pat. Nos. 4,108,742 and 4,111,779.

Membranes which can be tensioned by the apparatus of the present invention and which are used in electrolytic cells of the filter-press type include, for example, membranes having ion exchange properties and which are substantially impervious to the hydrodynamic flow of electrolyte and the passage of gas products produced in the cell. Cation exchange membranes such as those composed of fluorocarbon polymers having a plurality of pendant sulfonic acid groups or carboxylic acid groups or mixtures of sulfonic acid groups and carboxylic acid groups are typically employed in electrolytic cells. The terms "sulfonic acid groups" and "carboxylic acid groups" are meant to include salt of sulfonic acid or salts of carboxylic acid which are suitably converted to or from the acid group by processes such as hydrolysis. One example of a suitable membrane of the sulfonic acid type cation exchange membranes are those sold commercially by E. I. duPont de Nemours and Company under the trademark Nafion®. Carboxylic acid type cation exchange membranes are commercially available from the Asahi Glass Company under the trademark Flemion®.

What is claimed is:

1. A tentering apparatus for tensioning a sheet-like member comprising:

(a) at least four clamping assemblies adjacent to each other and arranged in a picture frame type configuration and adapted for clamping at least a portion of the periphery of the sheet-like member, the clamping assemblies comprising at least two elongated, generally planar members through which the said periphery of the sheet like material passes wherein the elongated portion of the members is adjacent and parallel to each other, and held together with a fastening means;

(b) at least four corner members interposed between the four clamping assemblies and adapted to be connected at the ends of the four clamping assemblies; and (c) at least one threaded rod directly connecting at least one of the corner members to at least one of the clamping assemblies, at least one threaded rod containing a wing nut for tensioning the sheet-like member at least in the vertical direction, wherein the sheet-like member is tensioned by at least one of the threaded rods and wing nuts.

2. The apparatus of claim 1 including at least one threaded rod containing a wing nut for tensioning the sheet-like member at least in the horizontal direction.

3. The apparatus of claim 1 wherein the planar members of the clamping assemblies are held together with at least one clamping screw.

4. A tentering apparatus for tensioning a sheet-like member conprising:

(a) at least four clamping assemblies adjacent to each other and arranged in a picture frame type configuration and adapted for clamping at least a portion of the periphery of the sheet-like member, the clamping assemblies comprising at least two elongated, generally planar members through which the said periphery of the sheet like material passes wherein the elongated portion of the members is adjacent and parallel to each other, and held together with a fastening means, at least one of the two elongated, generally planar members containing a means for gripping the sheet-like member;

(b) at least four corner members interposed between the four clamping assemblies and adapted to be connected at the ends of the four clamping assemblies; and (c) means for directly connecting the clamping assemblies to the corner members, wherein the sheet-like member is tensioned by at least one of the means of the means for connecting the clamping assemblies to the corner members.

5. The apparatus of claim 4 wherein the gripping means is defined by a securing member and a recess.

6. The apparatus of claim 5 wherein the securing member is made of resilient material.

7. The apparatus of claim 6 wherein the securing member is made of materials selected from the group consisting of rubber, ethylene-propylene-diene monomer, chlorinated polyethylene and neoprene.

* * * * *